US011118374B2

(12) United States Patent
Minter

(10) Patent No.: US 11,118,374 B2
(45) Date of Patent: Sep. 14, 2021

(54) STRAIGHT ACTION FLUSH LOCK FOR CASEMENT WINDOW AND METHOD OF OPERATING THE SAME

(71) Applicant: Interlock USA, Inc., Reno, NV (US)

(72) Inventor: Peter J. Minter, Reno, NV (US)

(73) Assignee: Interlock USA, Inc., Reno, NV (US)

( * ) Notice: Subject to any disclaimer, the term of this patent is extended or adjusted under 35 U.S.C. 154(b) by 0 days.

(21) Appl. No.: 16/871,896

(22) Filed: May 11, 2020

(65) Prior Publication Data

US 2020/0270897 A1 Aug. 27, 2020

Related U.S. Application Data

(60) Continuation-in-part of application No. 15/625,596, filed on Jun. 16, 2017, now Pat. No. 10,648,195, (Continued)

(51) Int. Cl.
*E05B 5/00* (2006.01)
*E05C 19/10* (2006.01)
(Continued)

(52) U.S. Cl.
CPC ..... *E05B 5/006* (2013.01); *E05B 5/00* (2013.01); *E05B 15/0006* (2013.01); *E05C 9/10* (2013.01); *E05C 19/10* (2013.01); *E05B 85/22* (2013.01); *E05C 1/00* (2013.01); *E05C 1/002* (2013.01); *E05C 1/006* (2013.01); *E05C 1/02* (2013.01); *E05C 1/08* (2013.01); *E05C 9/02* (2013.01); *E05C 9/028* (2013.01); *E05C 9/20* (2013.01); *E05C 9/22* (2013.01); *E05C 17/14* (2013.01); *E05C 17/48* (2013.01); *E05C 19/028* (2013.01);
(Continued)

(58) Field of Classification Search
CPC ..... E05B 5/0006; E05B 5/00; E05B 15/0006; E05B 5/22; E05C 9/10; E05C 19/10; E05C 17/14; E05C 9/02; E05C 19/028; E05C 1/00; E05C 1/002; E05C 1/004; E05C 1/006; E05C 1/02; E05C 1/08; E05C 17/48; E05C 2001/008; E05C 9/028; E05C 9/20; E05C 9/22; E05C 9/185; Y10T 292/0951; Y10T 292/0963; Y10T 292/0967; Y10T 292/0968; Y10S 292/31; Y10S 292/47; Y10S 292/62
See application file for complete search history.

(56) References Cited

U.S. PATENT DOCUMENTS 3,302,434 A 2/1967 Dauenbaugh et al.
3,492,037 A 1/1970 Hutchinson
(Continued)

*Primary Examiner* — Kristina R Fulton
*Assistant Examiner* — Faria F Ahmad
(74) *Attorney, Agent, or Firm* — DeLio Peterson & Curcio LLC; David R. Pegnataro

(57) ABSTRACT

A low profile actuating window lock for casement windows having a longitudinal slot in a sidewall of the casing for the lock, wherein an actuator including a fork component translates within the slot in a direction opposite movement of the handle, the handle pivotable about a restrictor arm that pivots relative to the casing, allowing the handle to rotate from the locked position to the unlocked position with low clearance from the window frame. The pivot points of the handle and restrictor arm configuration allow for an over center linkage that prevents back driving the casement window lock.

15 Claims, 13 Drawing Sheets

Related U.S. Application Data which is a continuation-in-part of application No. 14/793,820, filed on Jul. 8, 2015, now Pat. No. 9,777,509, which is a division of application No. 13/610,789, filed on Sep. 11, 2012, now Pat. No. 9,109,384.

(51) Int. Cl.

| | |
|---|---|
| ***E05B 15/00*** | (2006.01) |
| ***E05C 9/10*** | (2006.01) |
| ***E05C 9/20*** | (2006.01) |
| ***E05C 17/14*** | (2006.01) |
| ***E05C 1/08*** | (2006.01) |
| ***E05C 9/02*** | (2006.01) |
| ***E05C 1/00*** | (2006.01) |
| ***E05C 9/22*** | (2006.01) |
| ***E05C 1/02*** | (2006.01) |
| ***E05C 19/02*** | (2006.01) |
| ***E05B 85/22*** | (2014.01) |
| ***E05C 17/48*** | (2006.01) |

(52) U.S. Cl.

CPC ..... *E05C 2001/008* (2013.01); *Y10S 292/31* (2013.01); *Y10S 292/47* (2013.01); *Y10S 292/62* (2013.01); *Y10T 292/0951* (2015.04); *Y10T 292/0963* (2015.04); *Y10T 292/0967* (2015.04); *Y10T 292/0968* (2015.04)

(56) References Cited

U.S. PATENT DOCUMENTS 3,949,525 A 4/1976 Bates et al.
4,674,777 A 6/1987 Guelck
4,803,808 A 2/1989 Greisner
4,823,508 A 4/1989 Allen
4,937,976 A 7/1990 Tucker et al.
4,976,066 A 12/1990 Plummer et al.
4,991,886 A 2/1991 Nolte et al.
5,050,345 A 9/1991 Nakanishi
5,054,239 A 10/1991 Tucker et al.
5,118,145 A 6/1992 Tucker
5,152,103 A * 10/1992 Tucker ..... E05F 11/16 49/279
5,087,087 A 11/1992 Vetter et al.
5,219,195 A 6/1993 Lawrence
5,318,333 A 6/1994 Dreifert
5,323,568 A 6/1994 Blomqvist
5,370,428 A 12/1994 Dreifert et al.
5,531,045 A 7/1996 Piltingsrud
5,570,915 A * 11/1996 Asadurian ..... E05B 17/0037 292/216
5,618,068 A 4/1997 Mitsui et al.
D388,689 S 1/1998 Bauman et al.
D390,445 S 2/1998 Johnson et al.
5,730,477 A * 3/1998 Nagy ..... E05F 11/08 292/32
5,741,031 A 4/1998 Bauman et al.
5,778,602 A 7/1998 Johnson et al.
5,813,710 A 9/1998 Anderson
5,829,802 A 11/1998 Anderson et al.
5,927,768 A 7/1999 Dallmann et al.
6,109,668 A 8/2000 Demarco
6,230,457 B1 5/2001 Brautigam
6,354,639 B1 3/2002 Minter et al.
6,367,853 B1 4/2002 Briggs
6,425,611 B1 7/2002 Minter et al.
6,431,620 B2 8/2002 Tremblay et al.
6,434,887 B2 * 8/2002 Nakanishi ..... E05D 15/30 49/246
6,450,554 B1 9/2002 Rotondi et al.
6,651,389 B2 11/2003 Minter et al.
6,672,010 B1 1/2004 Gledhill et al.
6,767,038 B1 7/2004 Humi
6,837,004 B2 1/2005 Annes
7,617,707 B2 11/2009 Chiang
7,708,322 B2 5/2010 Timothy et al.
7,823,935 B2 11/2010 Norris et al.
7,900,322 B2 3/2011 Doring et al.
7,946,633 B2 5/2011 Minter
8,353,541 B2 1/2013 Minter
8,448,996 B2 5/2013 Lake et al.
8,683,746 B2 * 4/2014 Lambertini ..... E05F 11/16 49/394
8,726,572 B2 5/2014 Derham
9,109,384 B2 * 8/2015 Minter ..... E05B 15/0006
9,725,934 B2 * 8/2017 Vetter ..... E05B 1/0092
9,777,509 B2 * 10/2017 Minter ..... E05C 9/10
2001/0013202 A1 8/2001 Nakanishi et al.
2001/0019211 A1 * 9/2001 Tremblay ..... E05D 15/44 292/70
2002/0066162 A1 6/2002 Klompenburg et al.
2003/0079414 A1 5/2003 Rangabasyam et al.
2005/0223524 A1 * 10/2005 Muir ..... E05D 15/30 16/366
2008/0256874 A1 10/2008 Curtis et al.
2012/0036781 A1 2/2012 Runk et al.
2012/0180392 A1 7/2012 Lambertini
2013/0104458 A1 5/2013 Leung et al.
2014/0070547 A1 3/2014 Minter et al.
2016/0060919 A1 3/2016 Vetter

* cited by examiner

A-A

STRAIGHT ACTION FLUSH LOCK FOR CASEMENT WINDOW AND METHOD OF OPERATING THE SAME

BACKGROUND OF THE INVENTION

1. Field of the Invention

The present invention is directed towards window locks, and more particularly toward manual handles for actuating window locks. Specifically, the present invention is directed to a flush mounted or low profile actuating window lock for casement windows. More specifically, the present invention is directed to a flush mounted lock actuator designed to drive a lock bar that locks and unlocks a casement window, which protrudes from the window frame significantly less than prior art designs, while employing linkage to prevent the actuator from being back driven from either the locked position or unlocked position.

2. Description of Related Art

Generally, a casement window is a window unit in which the single vent cranks outward, to the right or left. Casement windows are hinged at the side. (Windows hinged at the top are referred to as awning windows.) They are used singly or in pairs within a common frame. Casement windows are often held open using a casement stay. Casement windows open like doors. Like doors, either the left or right side is hinged (or, more accurately, pivoted), and the non-hinged side locks securely into place by a lock bar driven by a lock handle. Unlike a door, the casement window opens not by a knob or handle but by means of some variation of a gear driven operator or lever, which is placed around hand height or at the bottom. A gear driven operator, stay, or friction hinge controlling the position of the sash is necessary when the window opens outward to hold the window in position during inclement weather, such as high winds.

The locking system for a casement window is typically on the side of the window. Lock handles for casement windows are known in the art. Generally, a lock handle is mounted on the frame of the casement window and moves an internally mounted fork component left or right. The fork component drives a lock or tie bar that is also mounted to the frame. One type of locking mechanism for a casement window uses a flat tie bar slidably mounted to the window frame along the open side of the window. The tie bar is provided with multiple pins for locking and driving that extend perpendicularly outward from the tie bar. A locking handle is provided on the interior of the window frame that can be thrown by the user between locked and unlocked positions. The locking handle slides the tie bar, which moves each locking pin between a corresponding locked and unlocked position. A typical lock bar and lock handle to drive the lock bar is shown in U.S. Pat. No. 7,946,633, entitled "Low Friction Adjustable Roller Pin," issued to Minter on May 24, 2011.

Lock handles of the prior art are known to protrude from the casement window frame at a distance of approximately 20-25 mm. This protrusion is due to the internal driving mechanism within the handle. Casement window lock handles of the prior art drive a fork component, which engages and slides the lock bar. In order to drive the fork component from one side to the other, the handle casing must have sufficient depth to allow for the handle to pivot about the casing and to allow the fork internally to shift from side to side.

The most relevant prior art does not teach or disclose a locking mechanism capable of low profile (on the order of 8 mm) flush mounting that can be adapted to work with existing tie bar locking designs. For example, in U.S. Pat. No. 5,087,087 issued to Vetter, et al., on Feb. 11, 1992, entitled "Sash Lock," a basic multipoint window lock mechanism is taught using an actuating lever/handle that drives a sliding lock bar. The actuating lever handle has a pin located at the opposite end from the handle end. The pin is engaged in and drives a fork component on the lock bar. This prior art does not disclose, describe, or suggest any type of linkage in combination with the fork component to achieve a significantly reduced profile lock actuation. Nor does this prior art design introduce additional linkage to prevent back driving the lock.

In U.S. Pat. No. 5,813,710 issued to Anderson on Sep. 29, 1998, entitled "Flush Lock Actuator," a lock actuator is disclosed to provide a "flush" lock appearance. However, for reasons discussed further herein, the low profile feature of this invention is provided with a design distinctly different from the present design. The Anderson design teaches a handle that is symmetrical and flush with the body of the actuator. The handle is pivoted with respect to the casing about its center on a pin. One end of the handle pivots towards (and into) the window frame, while the other end pivots out of the body and away from the frame. The end that pivots into the window has an actuating link attached to it that drives the lock bar. There is no restrictor arm for redirecting the pivot points of the handle to work in combination with a fork component to reduce the casing profile as taught by the present invention, nor is there a rotatable connector to prevent "over-opening" the lock.

In U.S. Pat. No. 5,829,802 issued to Anderson, et al., on Nov. 3, 1998, entitled "Multi-Point Lock Operator For Casement Window," a lock actuator is disclosed that drives a multipoint lock bar. Although the actuator handle is not flush, the handle swings a full 180° so that it lies flat at both the locked and unlocked limits of motion. The far end of the actuator handle drives a "universal" link that is connected to the lock bar. In this design, the handle is pivoted directly on the casing or body of the device, which is distinctly different than the present design. Consequently, there is no need for a restrictor arm or any additional linkage for over center security to prevent the lock handle from being back driven.

In general, the prior art is silent with respect to salient features of the present invention that achieve flush mounting and prevent back driving the lock.

SUMMARY OF THE INVENTION

Bearing in mind the problems and deficiencies of the prior art, it is therefore an object of the present invention to provide a casement window lock that is flush mounted with a significantly lower profile than the current state of the art.

It is a further object of the present invention to provide a casement window lock that allows for reversal of the handle from the locking position to the unlocking position, and vice versa.

In yet another object of the present invention, it is desirable to provide a casement window lock that prevents back driving the locking mechanism.

It is yet another object of the present invention to provide a casement window lock that includes a releasable latch mechanism to maintain the handle in a flush or low profile position when in a locked state.

The above and other objects, which will be apparent to those skilled in the art, are achieved in the present invention which is directed to a casement window lock comprising a casing having a body including a longitudinal slot in an exterior surface thereof, a restrictor arm pivotally attached at one end to the casing body and pivotally attached at the other end to a handle, an actuator including a fork component for engaging a lock bar and a body comprising opposing channels for slidably engaging portions of the casing body defining the longitudinal slot, and a handle in pivotal communication with the actuator at one end of the handle, and in pivotal communication with the restrictor arm at an intermediate point on the handle. Movement of the handle causes the actuator body to slide with the casing longitudinal slot in a direction opposite the direction of movement of the handle. When the handle is rotated to an unlocked position, the handle pivots about a first hinge point at the connection of the handle and actuator to cause a second hinge point at the connection of the handle and restrictor to traverse within the casing body in a first direction perpendicular to movement of the handle, and conversely when the handle is rotated to a locked position, the handle pivots about the first hinge point in an opposite direction to cause the second hinge point to traverse within said casing body in a second direction opposite the first direction.

The lock may include a plurality of hinges or pivot points forming an over center linkage to prevent back driving said lock, where the over center linkage includes a first hinge point rotatably joining the handle to the actuator, a second hinge point rotatably joining the handle to the restrictor arm, and third hinge point rotatably joining the restrictor arm to the casing, such that when the handle is in an unlocked position, the first hinge point is between the second and third hinge points, and the second hinge point is above an action line connecting the first and third hinge points, and when the handle is in the locked position, the second hinge point is between the first and third hinge points, and the second hinge point is below an action line connecting the first and third hinge points.

The actuator may include a detent spring operably coupled to the actuator body for engaging at least one detent formed in an interior surface of the casing body, wherein the detent spring provides tactile and audible indication that the actuator has reached an end of travel.

In an embodiment, the lock may further comprise a latch mechanism for releasably retaining the handle in a locked position. The latch mechanism comprises a shuttle translatable between a biased latch engaging position and a latch releasing position and including a projection integral with or connected to a top surface thereof for engaging an end of the handle when the handle is in a locked position, a spring normally biasing said shuttle in the latch engaging position, and a latch release depressible in a direction transverse to a longitudinal axis of the casing body. The latch release includes an angled face for mating with a correspondingly-angled face of said shuttle, such that when the latch release is depressed the angled mating surfaces convert transverse motion of the latch release into vertical motion of the shuttle to the latch releasing position, thereby compressing the spring and disengaging the shuttle projection from the handle end and allowing the handle to be rotated to an unlocked position.

The lock may further comprise a spring action push mechanism for releasing the handle from a locked position. The push mechanism comprises a housing integral with or connected to an interior of the casing body, and a pedestal at least partially disposed within the housing and normally biased into an extended position by a spring. When the handle is in a latched position, the handle contacts the pedestal to move the pedestal into a retracted position to compress the spring, and when the shuttle is in the latch releasing position, the spring is permitted to expand, thereby pushing the handle outward from the casing to allow for rotation of the handle to the unlocked position. The pedestal may include a lip for maintaining at least a portion of the pedestal within the housing when in the biased, extended position.

In an embodiment, the lock may further include a rotatable position stop for preventing the handle from over-rotating and contacting the casing and ensuring clearance therebetween as the handle is rotated to an unlocked position.

In another aspect, the present invention is directed to a method of securing a casement window, comprising actuating a flush lock for the casement window, wherein the casement window includes an elongated casing having a body defining a longitudinal slot in an exterior surface thereof, and the flush lock includes a restrictor arm pivotally attached at one end to the casing body and pivotally attached at the other end to a handle, an actuator including a body and a fork component for engaging a lock bar, the actuator body in slidable communication with the casing body within the longitudinal slot, a handle in pivotal communication with the actuator at one end of the handle and in pivotal communication with the restrictor arm at an intermediate point on the handle, and a plurality of hinges or pivot points forming an over center linkage to prevent back driving the lock, where the over center linkage includes a first hinge point rotatably joining the handle to the actuator, a second hinge point rotatably joining the handle to the restrictor arm, and a third hinge point rotatably joining the restrictor arm to the casing. The method comprises rotating the handle to an unlocked position, such that the first hinge point is between the second and third hinge points and the second hinge point is above an action line connecting the first and third hinge points, or rotating the handle to a locked position, such that the second hinge point is between the first and third hinge points and the second hinge point is below an action line connecting the first and third hinge points, and moving the actuator body within the longitudinal slot in a direction opposite the direction of movement of the handle.

In an embodiment, the flush lock may further include a latch mechanism for releasably retaining the handle in a locked position, the latch mechanism comprising a shuttle translatable between a biased latch engaging position and a latch releasing position and including a projection integral with or connected to a top surface thereof for engaging an end of the handle when the handle is in a locked position, a spring normally biasing the shuttle in the latch engaging position, and a latch release depressible in a direction transverse to a longitudinal axis of the casing body, where the latch release includes an angled face for mating with a correspondingly-angled face of the shuttle, such that when the latch release is depressed, the angled mating surfaces convert transverse motion of the latch release into vertical motion of the shuttle to the latch releasing position, thereby compressing the spring and disengaging the shuttle projection from the handle end and allowing the handle to be rotated to an unlocked position. The method further comprises engaging the shuttle projection with the end of the handle when the handle is rotated into the locked position to maintain the handle in a flush mounted position within the casing body. The method may further comprise the steps of depressing the latch release in a direction transverse to a longitudinal axis of the casing body to disengage the shuttle projection from the handle end, and rotating the handle to the unlocked position.

In another embodiment, the flush lock may further include a detent formed in an interior surface of the casing body and the actuator may include a detent spring operably coupled to the actuator body, and the method may further comprise the step of engaging the detent spring with the casing body detent as the handle is rotated to the unlocked position, the detent spring providing tactile and audible indication that the actuator has reached an end of travel.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE EMBODIMENT(S)

Figure 1:
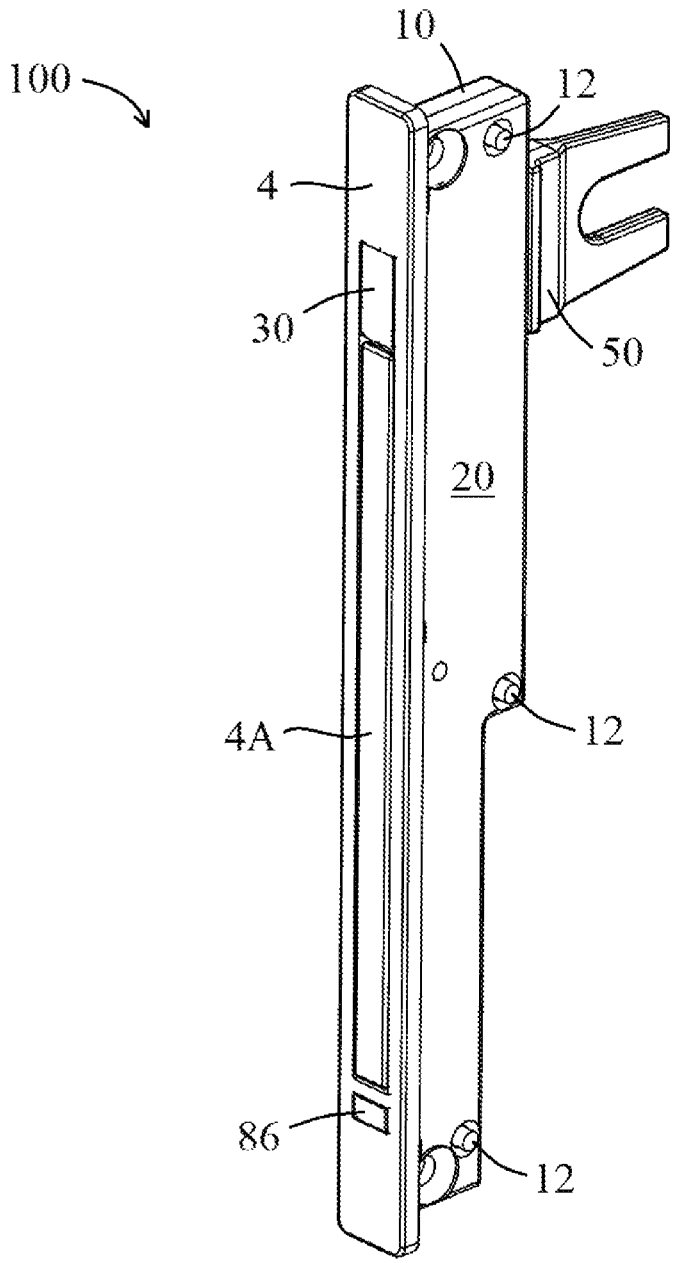
FIG. 1 is a front perspective view of an embodiment of the straight action flush lock for a casement window of the present invention, with the handle in the locked position.

In describing the embodiments of the present invention, reference will be made herein to FIGS. 1-17 of the drawings in which like numerals refer to like features of the invention.

Certain terminology is used herein for convenience only and is not to be taken as a limitation of the invention. For example, words such as "upper," "lower," "left," "right," "front," "rear," "horizontal," "vertical," "upward," "downward," "clockwise," "counterclockwise," "longitudinal," "lateral," or the like, merely describe the configuration shown in the drawings. Indeed, the referenced components may be oriented in any direction and the terminology, therefore, should be understood as encompassing such variations unless specified otherwise. For purposes of clarity, the same reference numbers may be used in the drawings to identify similar elements.

Additionally, in the subject description, the words "exemplary," "illustrative," or the like, are used to mean serving as an example, instance or illustration. Any aspect or design described herein as "exemplary" or "illustrative" is not necessarily intended to be construed as preferred or advantageous over other aspects or design. Rather, the use of the words "exemplary" or "illustrative" is merely intended to present concepts in a concrete fashion.

The lock of the present invention is a low profile, flush design, that protrudes from the window frame significantly less than the prior art, at about 8 mm compared to 25 mm in the current prior art designs. When locking a casement window, the window is closed generally by a crank. The strikes on the moving sash are brought close to the pins on a tie bar mounted to the non-moving window frame. The lock handle is then thrown. This drives an actuator or fork component within the lock, which engages the tie bar and drives it, moving the tie bar pins into engagement with corresponding hooks or strikes. The actuator or fork component is preferably a flat structure adapted to slide within the lock casing, preferably having two extensions, such as leg portions, for engaging a tie bar. The strikes generally have a ramp surface at their mouth and the pins slide up this ramp into engagement. This motion pulls the sash tightly against the window frame generating compression for sealing the sash to the window frame.

To achieve this "flush," low profile appearance, the locking mechanism of the present invention introduces a "three bar" linkage between the handle, a restrictor, and actuator element: the first of the three bar links formed by the handle between a first pivot at the actuator element and a second pivot at the restrictor, the second bar or link formed by the restrictor which pivots at each end thereof, and the third bar or link created by the actuator element and the sliding motion of the actuator element relative to a fixed pivot point of the restrictor on the body of the lock casing. The handle drives the movement of the actuator element, which translates within a longitudinal slot in the casing in a direction opposite movement of the handle. The restrictor redirects the pivot points of the handle to work in combination with the actuator element to reduce the casing profile. As the actuator element translates within the elongated slot in the casing, the pivot point of the handle and the restrictor shifts relative to the actuator element to allow the handle to rotate approximately 150° from an initial position. In prior art designs, the handle directly drives a fork component or the tie bar—structural limitations that result in a higher profile appearance. In the present design, the handle is allowed to move more deeply into the lock mechanism to reduce the height of the lock casing.

Referring now to FIGS. 1-17, collectively, an exemplary embodiment of the straight action flush lock mechanism of the present invention is shown. FIG. 1 depicts a perspective view of the straight action flush lock mechanism 100, with the handle in a locked position. The lock may be mounted to the frame of an otherwise conventional casement window (not shown). A removable cover and snap-on escutcheon 4, 4A concealing the handle and internal components of the lock, respectively, presents a more aesthetically pleasing appearance when the flush lock mechanism is installed, for example, in a wooden frame for a window. The escutcheon 4 and removable handle cover 4A may be colored or comprise a design pattern on a surface thereof to blend in or match the wood of the window frame.

Figure 2:
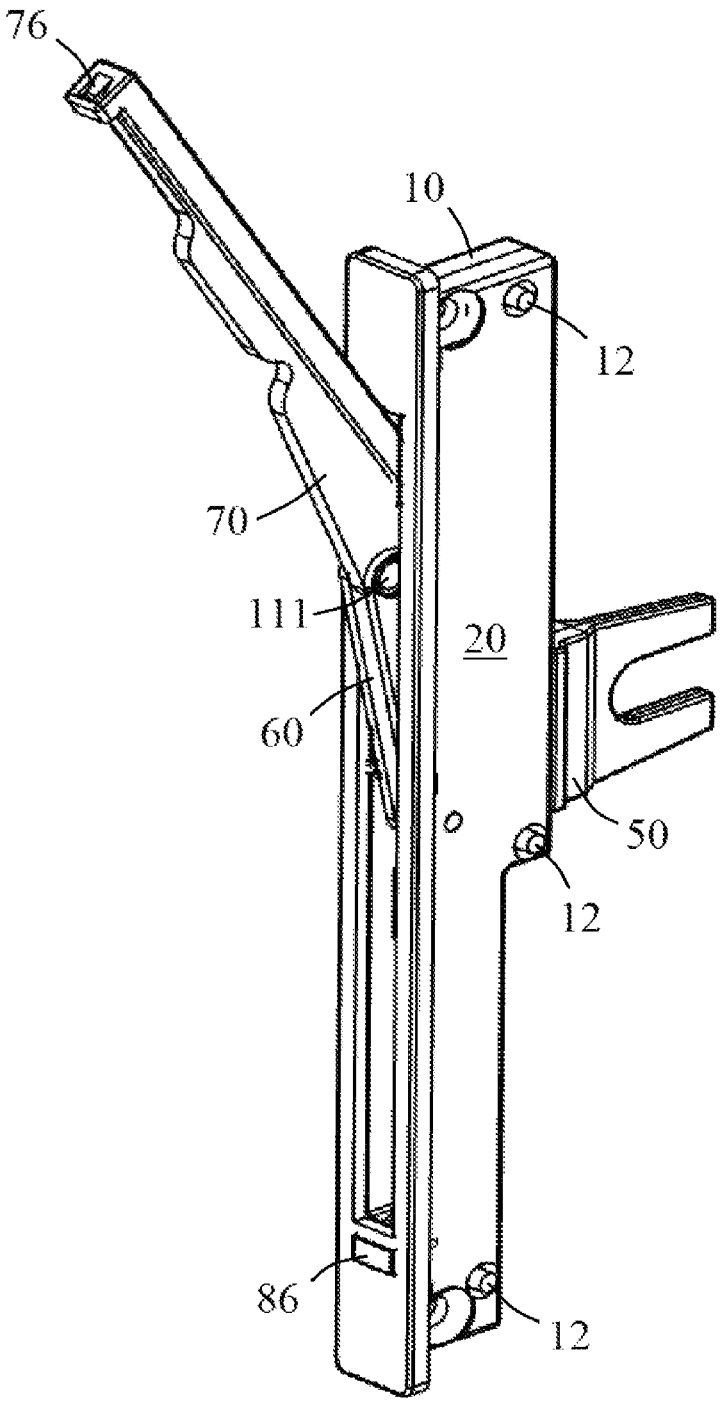
FIG. 2 is a front perspective view of the flush lock of FIG. 1, with the handle in the unlocked position.

The lock mechanism 100 includes a lever arm or handle 70, pivotable about a restrictor 60 through a hinge or pivot pin 111 (FIG. 2). For exemplary purposes, the elongated sidewalls of the casing 10, 20 will be deemed to be in a vertical direction, and movement by the actuator component 50 will be considered movement in the vertical direction. These assigned directions are provided only to facilitate descriptions regarding movement of components with respect to the casement window lock; they do not represent direction of the casement window lock after it is mounted on a window frame. It is noted, however, that casement window locks are generally mounted so that the elongated casing is positioned vertically.

Figure 3:
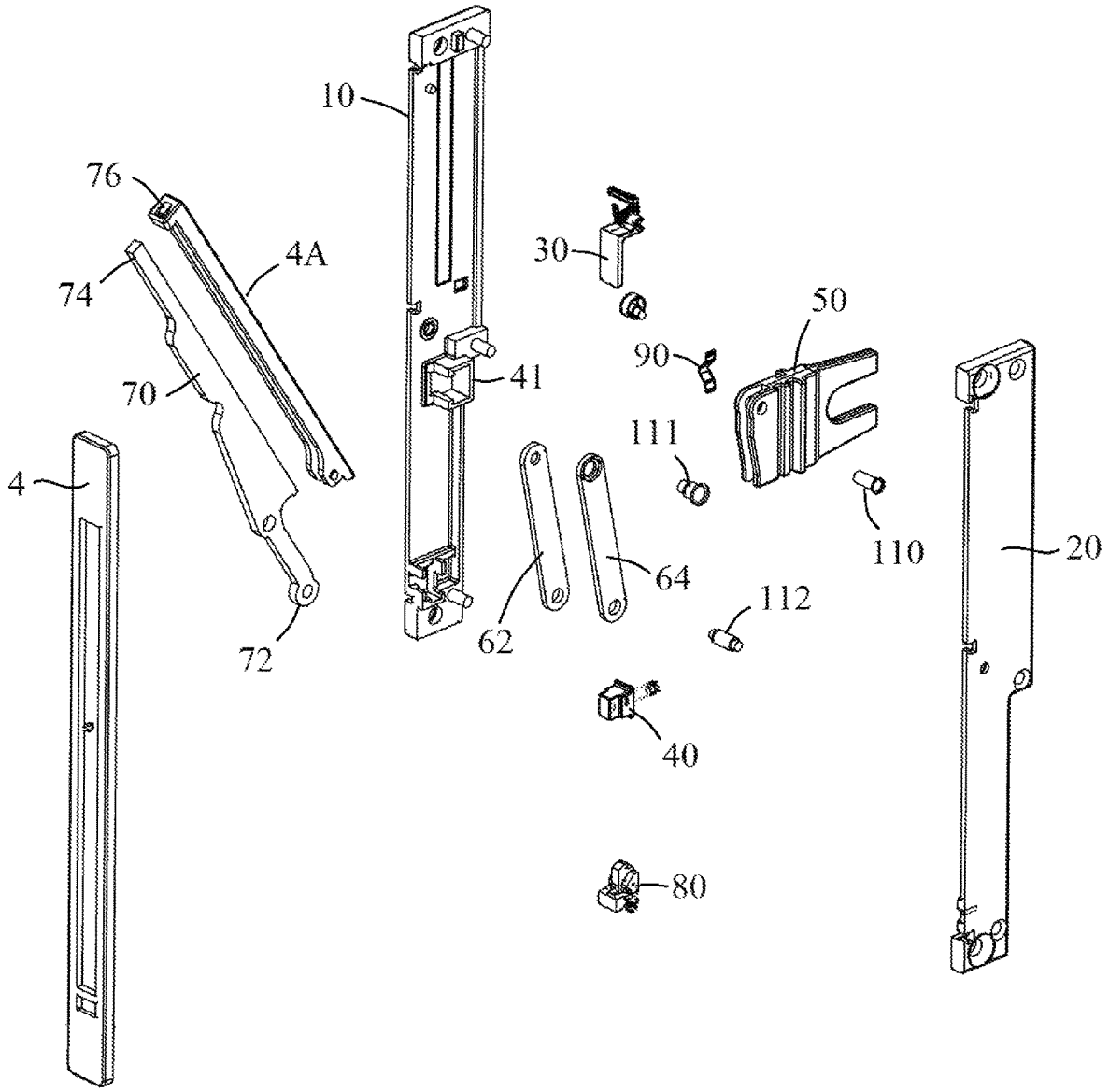
FIG. 3 is an exploded view of the flush lock of FIGS. 1 and 2.

FIG. 3 depicts an exploded view of the flush lock mechanism 100 of the present invention. Lock mechanism 100 includes a lever arm or handle 70, pivotable about a restrictor 60 comprising arms 62, 64 through a hinge or pivot pin 111 at an intermediate point of the handle. It should be understood by those skilled in the art that in other embodiments, restrictor 60 may be a single component comprising one elongated arm, as opposed to a pair of restrictor arms, without altering the functionality of the restrictor as further described herein.

Preferably, restrictor arms 62, 64 are riveted to handle 70; however, other attachment schemes may be employed provided handle 70 is rotatably attached to restrictor arms 62, 64 at the desired pivot location. Pivot pin 111 is preferably located at an intermediate point on handle 70 between the handle endpoints at a distance closer to the main casing 1 and escutcheon 4 than the handle's grip portion end 74. This allows for greater mechanical leverage by a user when pulling handle 70 upwards or pushing handle 70 downwards.

To further assist with handle stability during operation, a spring washer is preferably employed between restrictor 60 and main casing 1. This spring washer, preferably a Belleville spring washer, is capable of providing large amounts of force with very little deflection, thus allowing the present invention to provide upwards of 75 pounds of load with two-tenths of one millimeter (0.2 mm) of deflection. The spring washer also accommodates production variances while maintaining a pre-load force on restrictor arms 62, 64.

Figure 5:
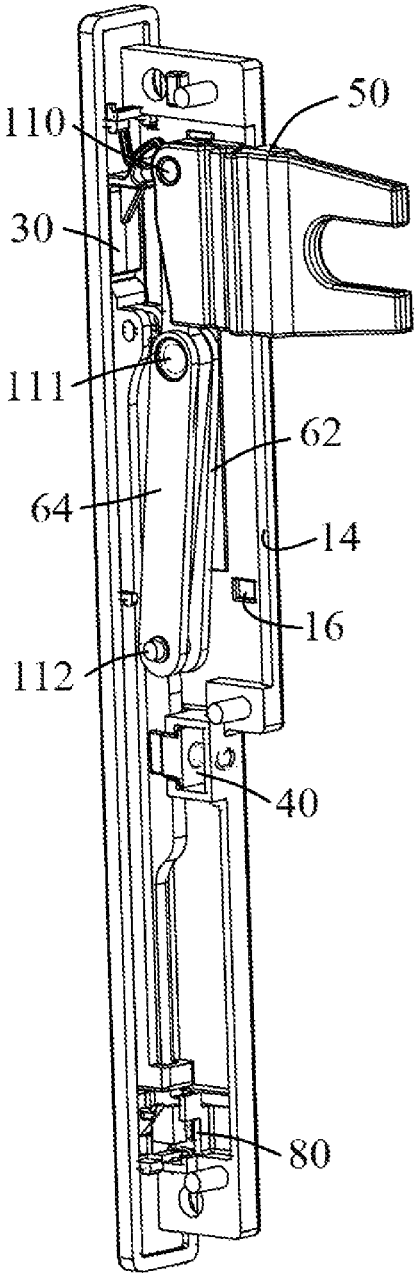

FIG. 5 further illustrates the connection of handle 70 to restrictor arms 62, 64 via pivot pin 111 at an intermediate point of handle 70, as well as the connection of actuator element 50 to a first end 72 of handle 70, rotatable about a hinge, pivot pin 110. As shown in the transition between FIGS. 5 and 7 (showing a locked and unlocked position of the handle, respectively), handle 70 is designed to pivot about restrictor 60 and actuator element 50 via pivot pins 110 and 111, respectively. Unlike the prior art, handle 70 is not directly connected to, nor does it pivot directly about, main casing 1 or escutcheon 4. As discussed further herein, this linkage contributes to the low profile design of the lock mechanism and the over center operation that prohibits back driving the flush lock mechanism.

Figure 6:
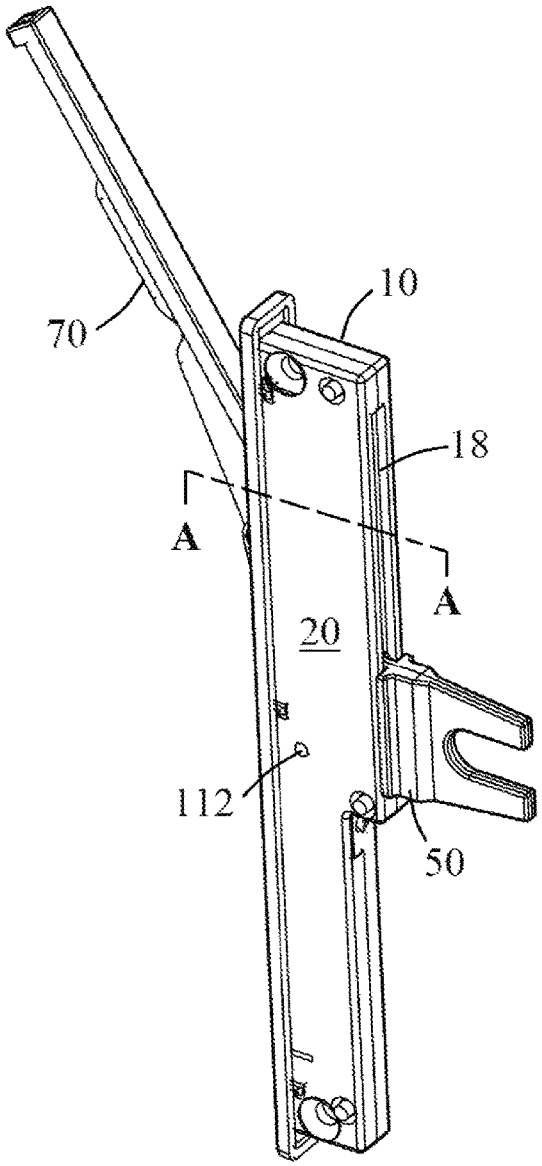
FIGS. 6 and 7 are rear perspective views, respectively, of the flush lock of FIG. 2. A portion of the lock housing or casing has been removed in FIG. 7 to show the positioning of the interior components of the lock assembly.
Figure 7:
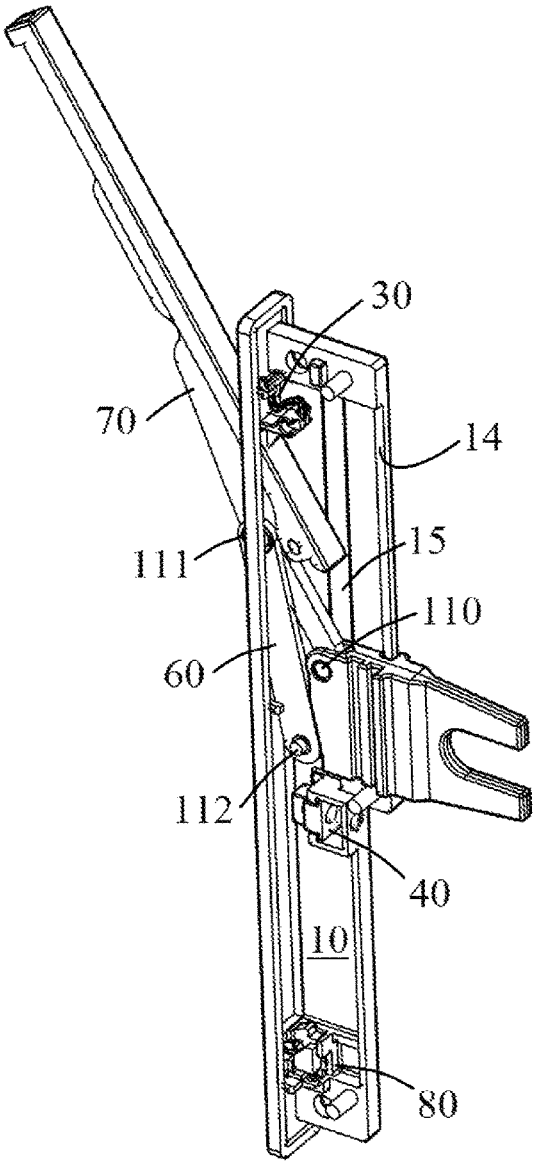

FIGS. 6 and 7 depict the handle 70 in a fully opened position. In a preferred embodiment, pivot pin 111 gradually shifts vertically, as well as transversely (in the direction of the exterior of the lock mechanism and away from the actuator element 50), over the length of travel as the actuator element 50 moves vertically within slot 18 along main casing 1, as the handle rotates from a locked to an unlocked position. Without such rising, a binding condition would be experienced as the actuator element is moved through its vertical transition. Thus, in the preferred embodiment, actuating handle 70 serves to move pivot pin 111 simultaneously to a raised (or lowered) position while the actuator element 50 is moved vertically within slot 18, as the handle rotates between locked and unlocked positions. This allows handle 70 "clearance" to rotate about its pivot points without requiring extra depth to the casing, and in fact, reducing the depth of the casing, making the casement window lock more flush with the mounting frame.

As further shown in FIG. 7, in at least one embodiment, a spring-biased, rotatable plate 30 is disposed within a top portion of the casing for preventing the handle 70 from over-rotating and contacting the escutcheon or casing. As the handle is rotated to an open position, plate 30 rotates into the casing and acts as a stop to prevent handle 70 from rotating into escutcheon 4 and ensuring clearance therebetween. In a locked position, as shown in FIG. 1, rotatable plate 30 is in a "home" position and covers what would otherwise be an open segment between the escutcheon 4 and the top edge of handle 70. As shown in the Figures, this otherwise open segment is necessary to provide clearance for the handle to rotate upwards and into the casing when the handle 70 moves from a locked to an unlocked position, as pivot point 111 shifts vertically, as well as transversely in the direction of the exterior of the lock mechanism.

An actuator element 50 is employed that is similar to some prior art designs, insomuch as a fork component 58 is used to engage a tie bar during locking and unlocking actuation. Fork component 58 drives a tie bar or lock bar that is mounted to the casement window frame. The tie bar engages a series of strikes that are mounted to the moving sash. Once the tie bar is engaged with the strikes, the window is locked. As best seen in FIG. 7, one end of handle 70 pivotally connects to actuator element 50 via hinge or pivot pin 110, which may be a rivet or other rotatable, pivoting attachment. The opposite end of restrictor 60 is pivotally connected to casing 1 via hinge or pivot pin 112. Pivot pin 112 is fixed to the casing 1, while pivot pins 110 and 111 are allowed to shift as the handle moves between open and closed positions.

Upon actuation of the handle 70, as the actuator element 50 translates vertically within slot 18 defined between casing halves 10, 20, the pivot pin 111 connecting the handle 70 and restrictor 60 shifts vertically, as well as transversely, relative to pivot pin 110 to allow the handle to rotate from an initial position. In one embodiment, handle 70 is permitted to rotate approximately 150° from its initial position, as shown in FIGS. 6 and 7. As shown in the transition between FIGS. 5 and 7, pivot pin 110 slides directly vertically, while pivot pin 111 shifts from either side of a line of action between pivot pins 110 and 112, as will be described below. In at least one embodiment, casing halves 10, 20 each include a recessed channel, such as channel 15 shown in FIG. 7, to accommodate the movement of pivot pin or rivet 110 as the actuator 50 translates within slot 18.

The relationship between the hinged points of the present invention interplays with the translation of the motion of handle 70 and actuator element 50, as the restrictor 60 redirects the pivot points of the handle to work in combination with the actuator element to reduce the casing profile and present a "flush" or low profile appearance of the handle.

Figure 8:
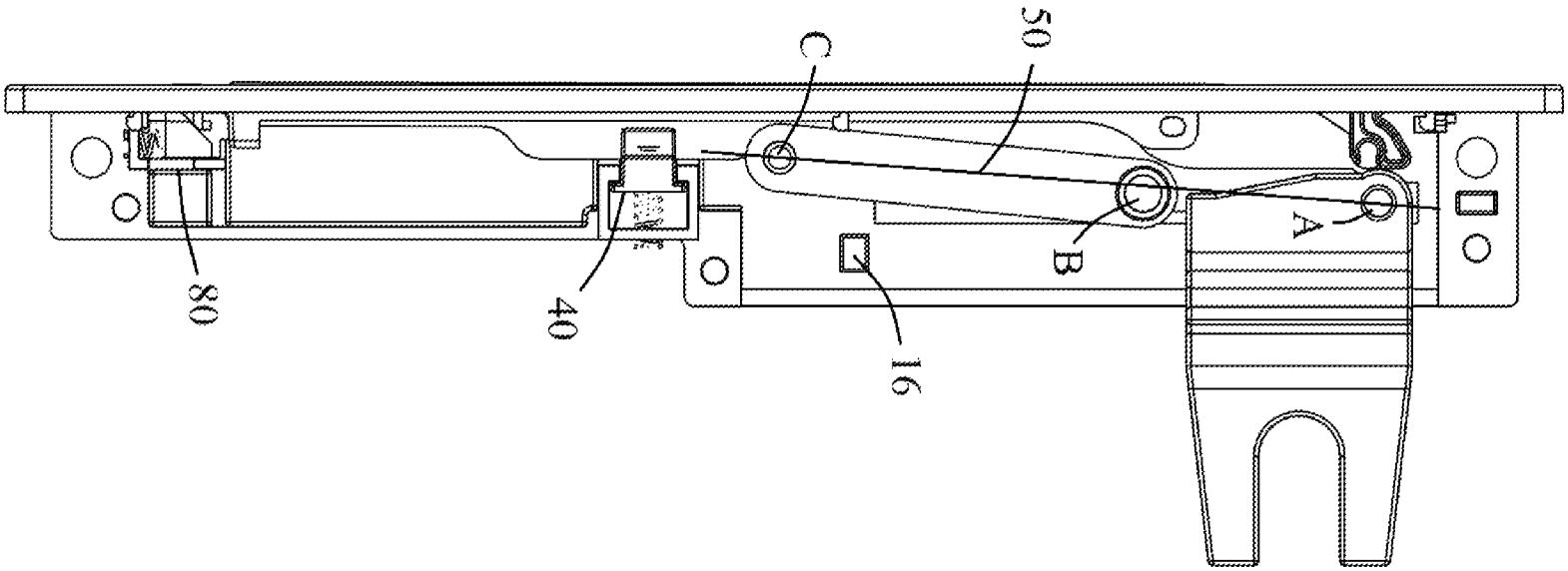
FIG. 8 is a side plan view of the flush lock of FIG. 1, with a portion of the lock housing or casing removed to show the positioning of the three-bar, over center linkage when the handle is in the locked position.
Figure 9:
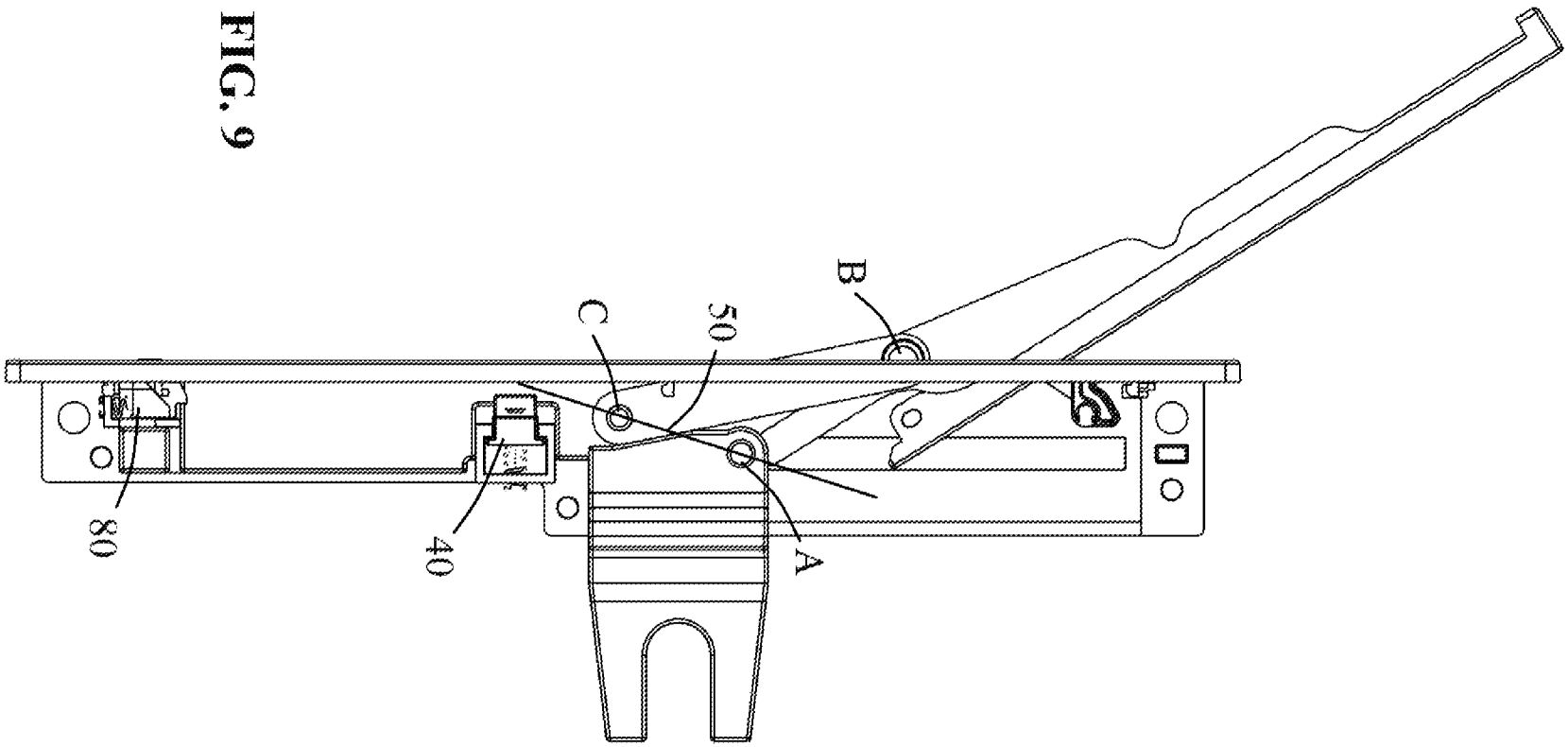
FIG. 9 is a side plan view of the flush lock of FIG. 2, with a portion of the lock housing or casing removed to show the positioning of the three-bar, over center linkage when the handle is in the unlocked position.

As shown in FIGS. 8 and 9, hinge A or pivot 110 is the pivotal junction of handle 70 and actuator element 50. Hinge B or pivot 111 is the pivotal junction of handle 70 with restrictor arms 62, 64 at an intermediate point on handle 70. Hinge C or pivot 112 is the pivotal junction of restrictor arms 62, 64 with the casing.

FIG. 8 is a side, plan view of the lock mechanism of the present invention with casing half 20 of the casing removed, depicting the positioning of three hinge points A, B, C when handle 70 is in the locked position. Hinge B is shown below the line of action 50 between hinges A and C. This relationship allows for the locking mechanism to utilize over center linkage at the ends of travel, and prevents the system from being back-driven (i.e., someone trying to break into the window by reversing the locking mechanism). Since hinge B is below the line of action 50 between hinges A and C, the system is not back drivable. In this manner, this configuration produces a "three bar linkage" design. It also allows handle 70 to move over a very wide operating angle and return to a "flush" or low profile position. The first of the three bar links is formed by handle 70 between the pivot 110 (hinge A) connected at actuator element 50 and pivot 111 (hinge B) connected at restrictor 60. A second bar or link is formed by restrictor 60 and pivots at each end thereof (hinges B and C). The third bar or link of the three bar linkage is created by actuator element 50 (hinge A) and the vertical sliding motion of actuator element 50 relative to the fixed pivot point 112 of the restrictor on the body of the casing (hinge C). The three bar linkage uses these three links pivotally connected at the ends (pivot points) so that the three links can move relative to each other.

When handle 70 is at either end of its travel, the three bar linkage design moves one pivot or hinge on the handle to an over center position relative to the two other pivot or hinge points. This over center position prevents the tie bar or lock bar from being back driven to the unlocked position when an "opening" force is applied to rotate handle 70. As shown in FIG. 8, when handle 70 is down (or in the locked position), the pivot connection (hinge B) between handle 70 and restrictor arms 62, 64 will be below line of action 50 defined between the pivot point of the handle and fork component (hinge A) and the fixed pivot point between the restrictor arm and the casing body (hinge C).

At the other extreme, as shown in FIG. 9 with handle 70 in an unlocked position, the second pivot connection on the handle (the pivot point on restrictor arm, hinge B) will have moved past and above the line of action 50 defined between the first pivot point on the handle at the fork component (hinge A) and the fixed pivot point between the restrictor arm and the body of the casing (hinge C). In each case, a hinge point moves "over center" to prevent the lock mechanism from being reverse driven. In other words, one of the three pivot points moves across a line of action that connects two other pivot points.

Figure 4:
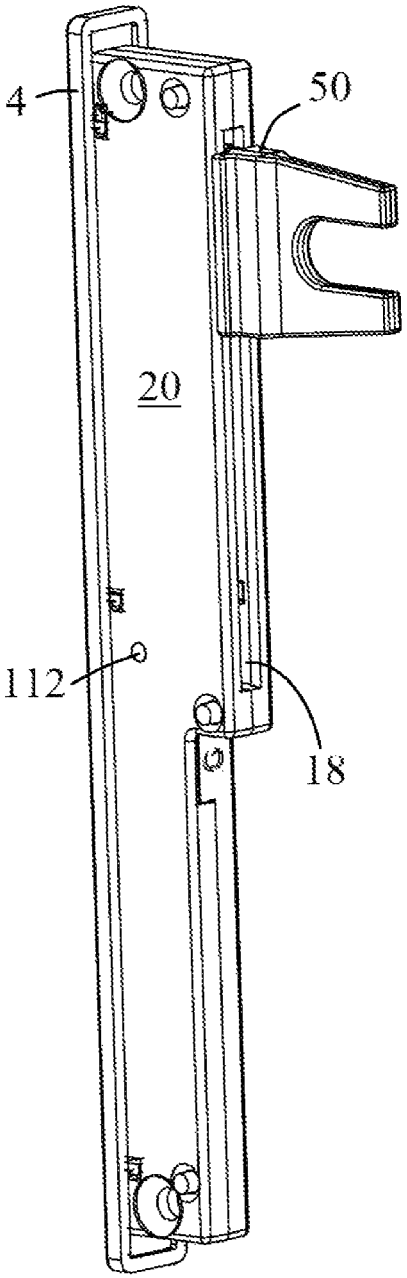
FIGS. 4 and 5 are rear perspective views, respectively, of the flush lock of FIG. 1. A portion of the lock housing or casing has been removed in FIG. 5 to show the positioning of the interior components of the lock assembly.
Figure 10:
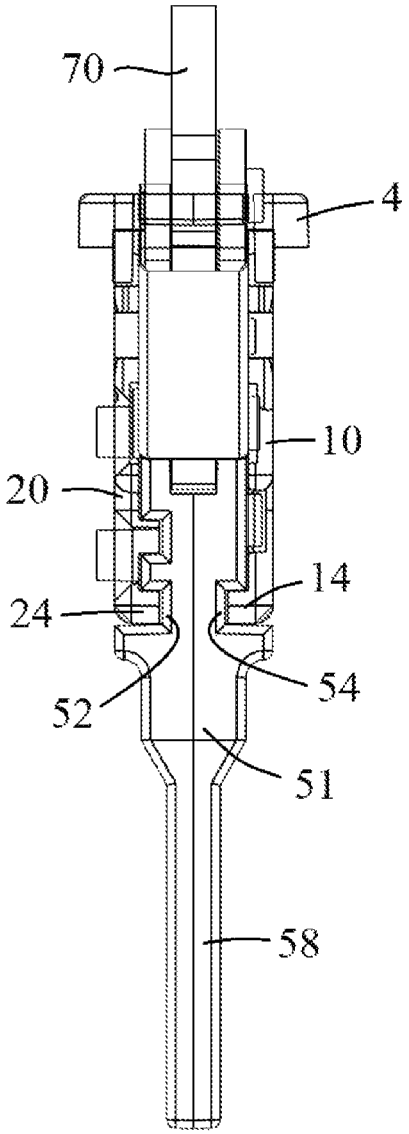
FIG. 10 is a top cross-sectional view of the flush lock of FIG. 6, taken along line A-A.

Referring now to FIG. 10, a top cross-sectional view of the flush lock mechanism 100 of the present invention is shown. Casing 1 comprises a first case half 10 and a second case half 20, wherein each case half includes a lateral protrusion or extension 14, 24 extending perpendicular to the major surfaces of the casing halves. Lateral extensions 14, 24 each include a cutout portion defining longitudinal slot 18 for receiving a body portion of actuator element 50 therein (FIGS. 4 and 6). One or more assembly bores 12 are provided for allowing first case half 10 and second case half 20 to be releasably coupled to one another, such as by snap fit or via suitable fasteners (not pictured).

Figure 11:
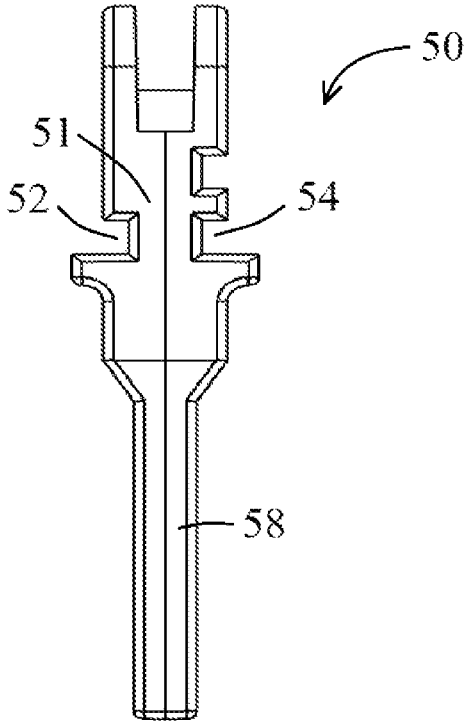
FIG. 11 is a top plan view of the actuator element of the straight action flush lock of the present invention.
Figure 12:
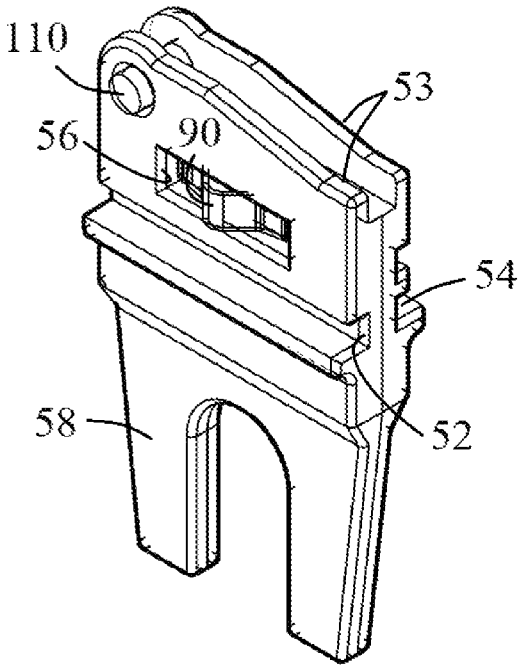
FIG. 12 is a perspective view of the actuator element of FIG. 11, showing a detent spring disposed within a side channel thereof.

Actuator element 50 includes a fork component 58 extending from a body portion 51 thereof for engaging a tie bar during locking and unlocking, and a tabbed portion 53 configured for operably coupling to handle 70 via pivot pin 110 (FIGS. 11-12). Body portion 51 is configured to fit within a recess formed by case halves 10, 20, respectively, as the actuator element 50 is driven by handle 70. As further shown in FIGS. 11 and 12, body portion 51 includes track segments or channels 52, 54 on opposing sides thereof for receiving lateral extensions 14, 24 of casing halves 10, 20. Handle 70 is received between tabbed portions 53 of actuator body 51, each tabbed portion comprising an aperture for receiving pivot pin 110 therethrough to pivotally connect handle 70 to actuator element 50. Channels 52, 54 act as an alignment track for slidably engaging with lateral extensions 14, 24 as the actuator element 50 translates within longitudinal slot 18 of the lock casing, preventing rotation of the actuator element (FIG. 10).

Figure 16:
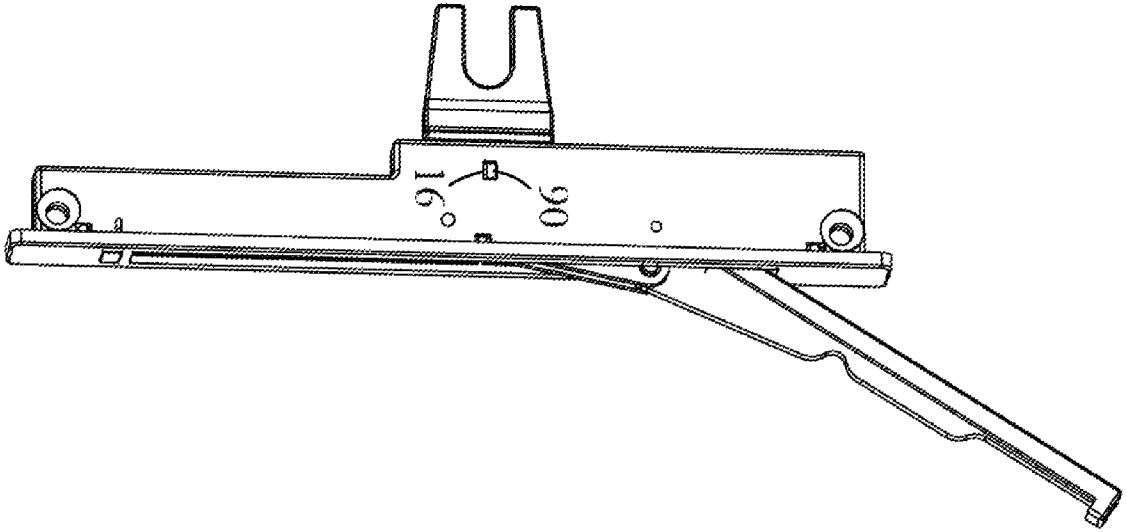
FIGS. 16 and 17 are rear plan views of an embodiment of the flush lock of the present invention in an unlocked position. A portion of the lock housing or casing has been removed in FIG. 17 to show the position of the detent spring and actuator element.
Figure 17:
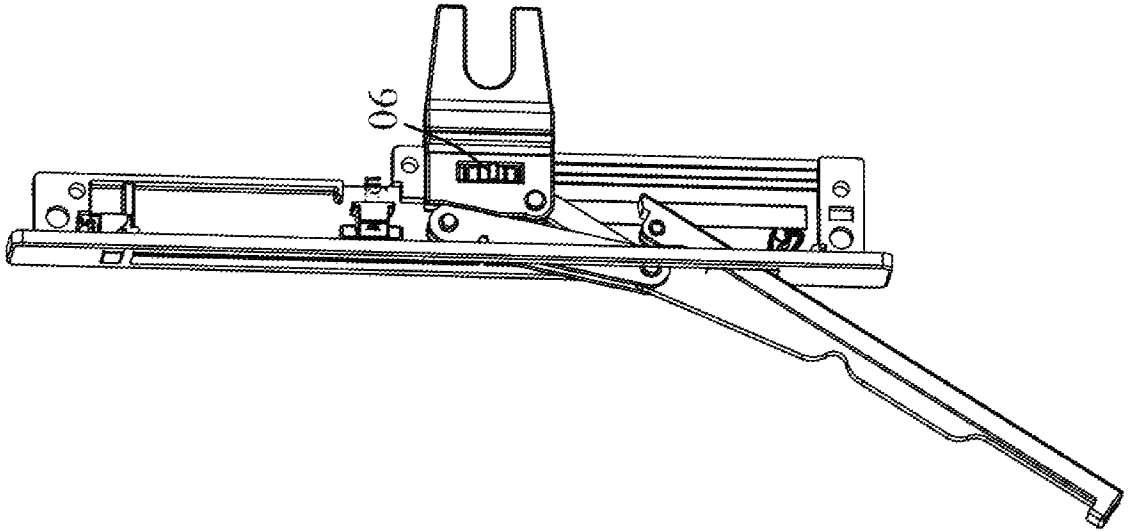

As further shown in FIG. 12, in an embodiment of the present invention, actuator body 51 may include a recess 56 for housing a detent spring 90. Detent spring 90 extends between the actuator body 51 and the inner surface of casing half 10, such that as the actuator element translates within slot 18 from a locked to an unlocked position, detent spring 90 contacts the inner surface of casing half 10 until engaging detent 16 when handle 70 is in an unlocked position (FIGS. 16-17). Detent spring 9 provides tactile and audible indication that the lock mechanism has reached its end of travel. Additionally, detent 16 helps sustain handle 70 in the correct position at its end of travel, and prevents the handle from unintentionally moving to a locked position under force of the tie bar, for example. It should be understood by those skilled in the art that in other embodiments, casing half 10 may include a second detent at or near a top portion thereof indicating a handle locked position at an opposite end of travel.

Figure 13:
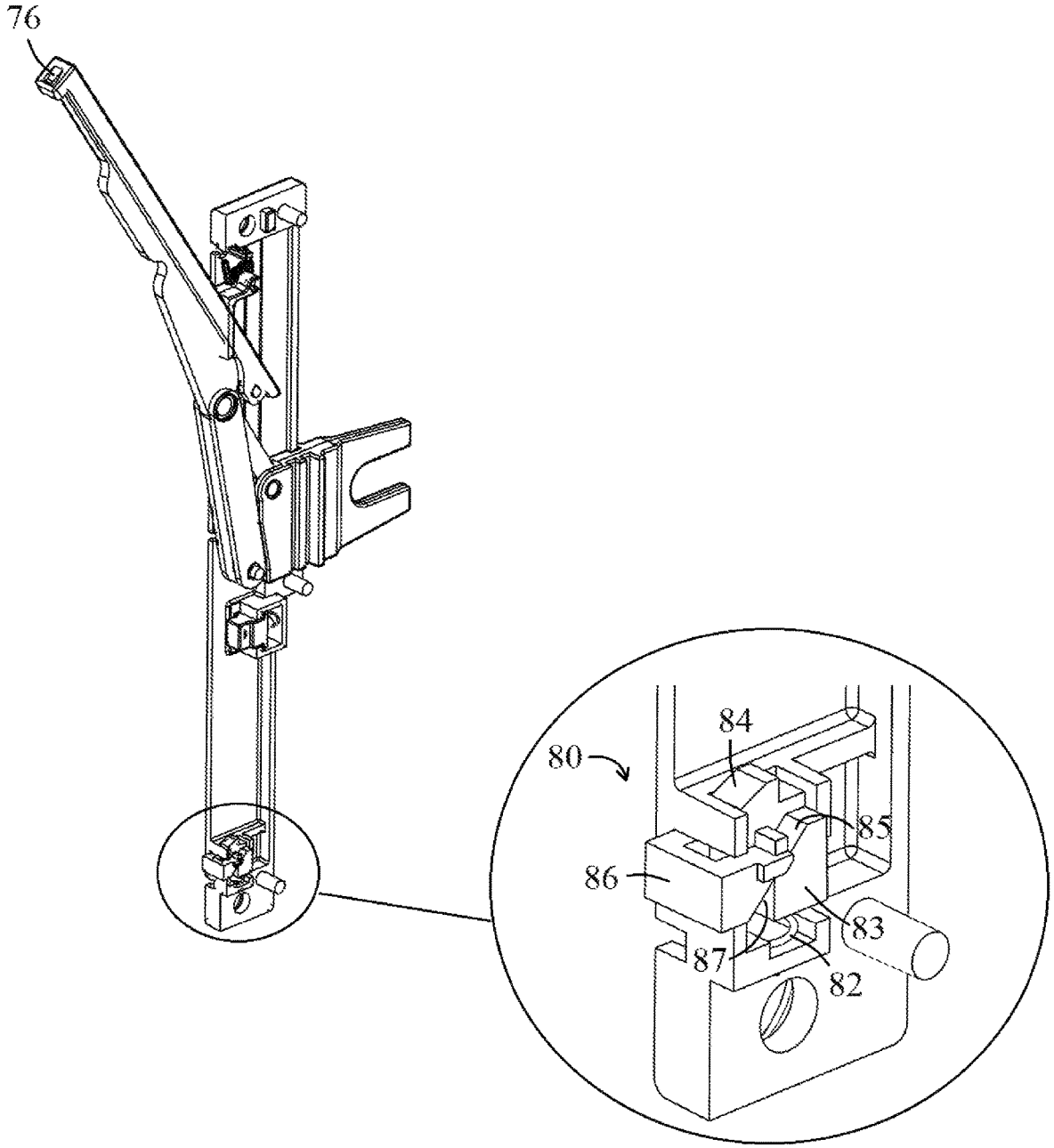
FIG. 13 is a perspective view of the latch mechanism of the straight action flush lock of the present invention, with the handle in an unlatched position.
Figure 14:
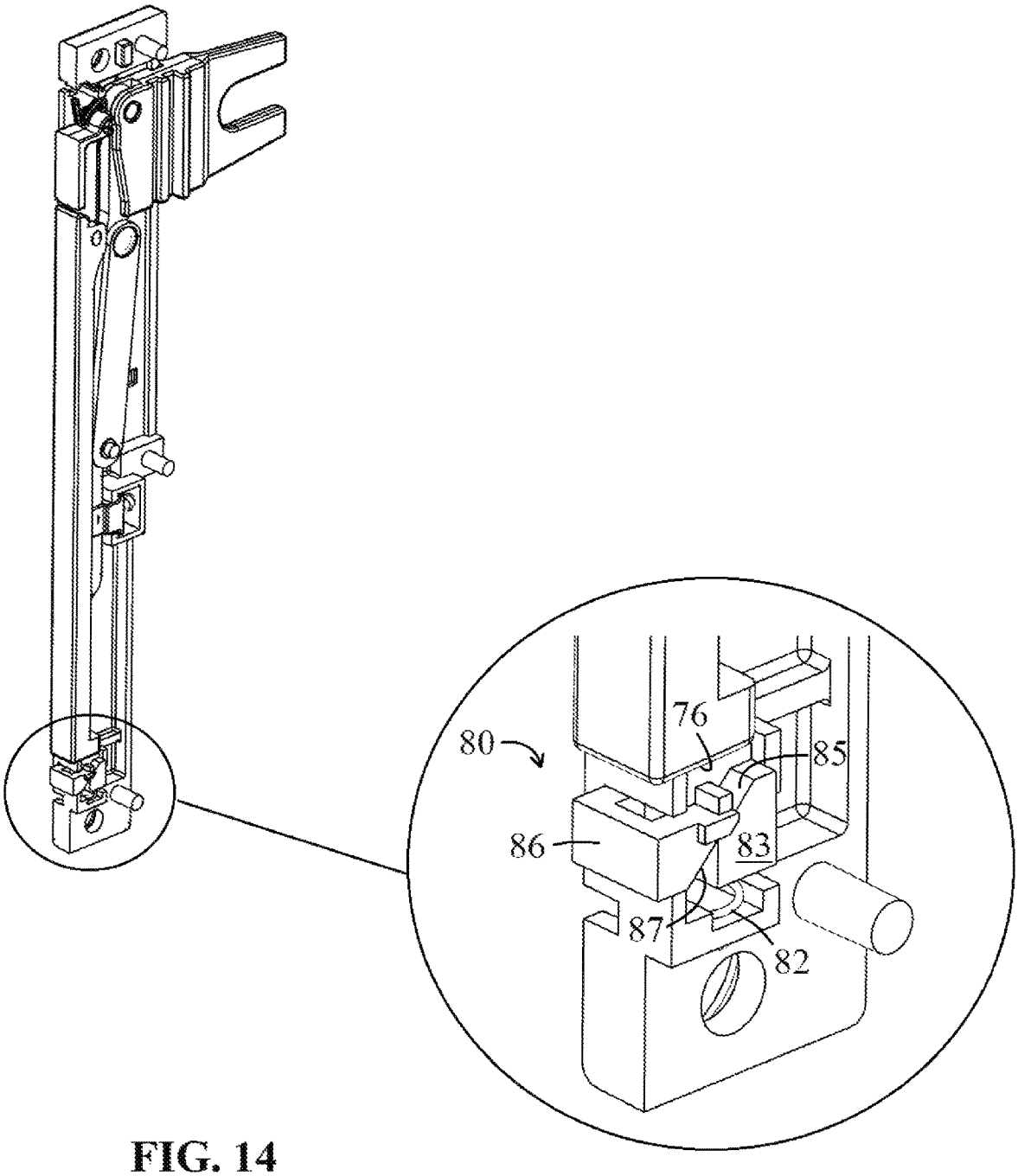
FIG. 14 is a perspective view of the latch mechanism of FIG. 13, with the handle in a latched position.

As best seen in FIGS. 13-14, in an embodiment of the present invention, a releasable latch mechanism 80 is further provided to maintain handle 70 flush with the casing when in a locked position. Latch mechanism 80 comprises a shuttle 83 normally biased in first, latch engaging position by spring 82, and including an angled projection 84 for engaging an indentation or detent 76 at handle second end 74 when the handle is in a locked position. As handle 70 is moved to a locked position, handle second end 74 contacts angled projection 84, causing shuttle 83 to translate downward, momentarily compressing spring 82 such that projection 84 clears the handle second end 74. As projection 84 clears the handle second end, the compressed shuttle spring 82 is released, allowing projection 84 to be biased into detent 76 to maintain the handle in a latched position.

To release handle 70, latch release button 86 is manually pressed toward the interior of the lock body, to move the shuttle 83 to a second, latch releasing position. Latch release 86 includes a correspondingly-angled face 87 for mating with shuttle angled face 85, such that when latch release 86 is depressed, the angled mating surfaces 85, 87 of the latch release 86 and shuttle 83, respectively, convert the transverse motion of the latch release button 86 into downward vertical motion of the shuttle 83, thereby compressing spring 82 and pulling projection 84 downward, releasing the projection from handle detent 76 and allowing the handle to be rotated to an unlocked position (FIG. 13).

Figure 15:
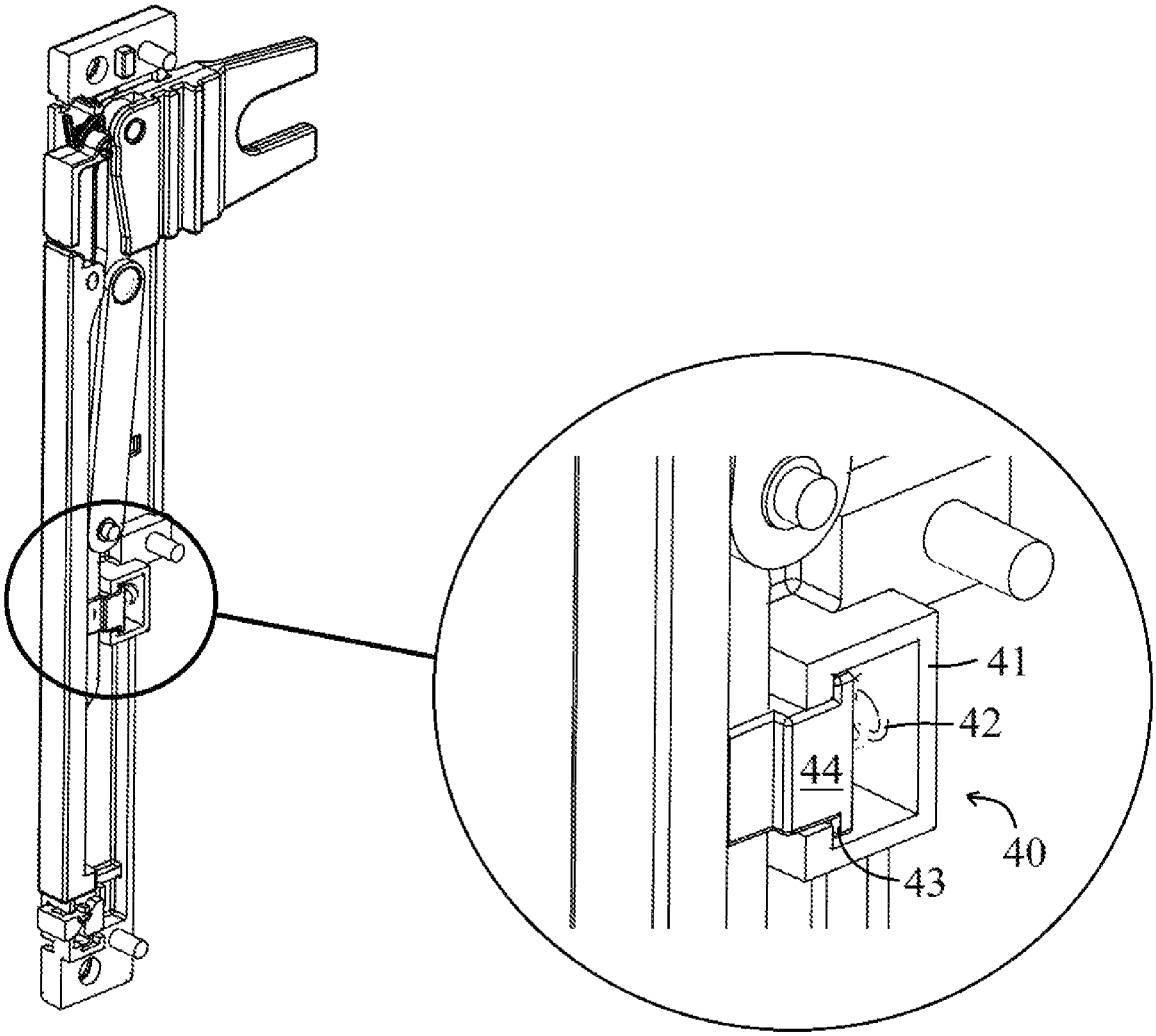
FIG. 15 is a perspective view of the push mechanism of the straight action flush lock of the present invention, with the handle in a latched position.

As further shown in FIG. 15, in at least one embodiment, the lock mechanism 100 may include a spring action push mechanism 40 for releasing handle 70 from a flush, locked position relative to the casing 1. Push mechanism 40 includes a spring 42, such as a compression spring, embedded in a housing 41. Housing 41 may be integral with or connected to an inner surface of casing 1. Spring 42 normally biases a pedestal 44 toward the exterior of the lock body, where pedestal 44 includes a lip 43 for maintaining a portion of pedestal 44 within housing 41 when in the biased, extended position. When handle 70 is in a locked and latched position, as shown in FIG. 15, handle 70 contacts pedestal 44 to compress spring 42 into housing 41. When latch shuttle 83 is released and latch projection 84 clears the handle second end 74, push mechanism spring 41 is permitted to expand, thereby pushing handle 70 outward from casing 1 to allow for rotation to the unlocked position (FIG. 2). In this manner, latch mechanism 80 and push mechanism 40 operate in conjunction to allow for handle 70 to release from a flush, latched position to an unlocked position.

The present invention achieves a low profile casement window lock that far exceeds the profile depth of casement window locks of the prior art by introducing a restrictor to present a "three bar" linkage between the handle, restrictor, and actuator element. The handle drives the movement of the actuator element, which translates within a longitudinal slot in the casing in a direction opposite movement of the handle. The restrictor arm redirects the pivot points of the handle to work in combination with the actuator element to reduce the casing profile. The present invention establishes a locking structure with multiple pivoting points that allows the handle to rotate approximately 150° with minimally required clearance in the casing or housing. The pivoting action of the handle and restrictor arm allows the handle to move the fork component horizontally while raising or lowering the restrictor arm pivot pin in relation to the fork component, with the fork component in slidable communication with a longitudinal slot in a sidewall of the casing. The multiple pivoting action provides for a three bar linkage that secures the casement window lock in either the open, unlocked position, or closed, locked position, and prevents back driving the lock mechanism in the reverse direction.

While the present invention has been particularly described, in conjunction with specific embodiment(s), it is evident that many alternatives, modifications, and variations will be apparent to those skilled in the art, in light of the foregoing description. It is therefore contemplated that the appended claims will embrace any such alternatives, modifications, and variations as falling within the true scope and spirit of the present invention.

Thus, having described the invention, what is claimed is:

The invention claimed is:

1. A casement window lock, comprising:

a casing having a body including a longitudinal slot in an exterior surface thereof;

a restrictor arm pivotally attached at one end to said casing body at a first pivot point, and pivotally attached at the other end to a handle at a second pivot point;

an actuator including a fork component for engaging a lock bar and a body comprising channels on opposing sides thereof for slidably engaging lateral extensions of said casing body, said lateral extensions defining said longitudinal slot; and said handle in pivotal communication with said actuator at one end of said handle at a third pivot point, and in pivotal communication with said restrictor arm at an intermediate point on said handle at said second pivot point, wherein, when said handle is rotated to an unlocked position, said handle pivots about said first pivot point to cause said second pivot point to traverse within said casing body in a first direction perpendicular to movement of the handle, and when said handle is rotated to a locked position, said handle pivots about said first pivot point in an opposite direction to cause said second pivot point to traverse within said casing body in a second direction opposite said first direction, and further wherein movement of the handle causes said actuator body to slide within said longitudinal slot in a direction opposite the direction of movement of the handle.

2. The casement window lock of claim 1 including a plurality of hinges or pivot points forming an over center linkage to prevent back driving said lock.

3. The casement window lock of claim 2 wherein said over center linkage includes:

a first hinge point rotatably joining said handle to said actuator;

a second hinge point rotatably joining said handle to said restrictor arm; and a third hinge point rotatably joining said restrictor arm to said casing;

such that when said handle is in the unlocked position, said first hinge point is between said second and third hinge points, and said second hinge point is above an action line connecting said first and third hinge points, and when said handle is in said locked position, said second hinge point is between said first and third hinge points, and said second hinge point is below an action line connecting said first and third hinge points.

4. The casement window lock of claim 1 wherein said actuator includes a detent spring operably coupled to said actuator body for engaging at least one detent formed in an interior surface of said casing body, said detent spring providing tactile and audible indication that said actuator has reached an end of travel.

5. The casement window lock of claim 1 further including a spring washer attached between said restrictor arm and said casing body, said spring washer capable of providing force at minimal deflection.

6. The casement window lock of claim 1 further comprising a latch mechanism for releasably retaining said handle in the locked position, said latch mechanism comprising:

a shuttle translatable between a biased latch engaging position and a latch releasing position, the shuttle including a projection integral with or connected to a top surface thereof for engaging an end of said handle when said handle is in the locked position;

a spring normally biasing said shuttle in the latch engaging position; and a latch release depressible in a direction transverse to a longitudinal axis of the casing body, said latch release including an angled face for mating with a correspondingly-angled face of said shuttle, wherein when said latch release is depressed, said angled mating surfaces convert said transverse motion of the latch release into vertical motion of said shuttle to said latch releasing position, thereby compressing said spring and disengaging said shuttle projection from said handle end and allowing said handle to be rotated to the unlocked position.

7. The casement window lock of claim 6 further comprising a spring action push mechanism for releasing said handle from the locked position, said push mechanism comprising:

a housing integral with or connected to an interior of the casing body; and a pedestal at least partially disposed within said housing and normally biased into an extended position by a spring, wherein when said handle is in a latched position, said handle contacts said pedestal to move said pedestal into a retracted position to compress said spring, and wherein when said shuttle is in said latch releasing position, said spring is permitted to expand, thereby pushing said handle outward from said casing to allow for rotation of said handle to the unlocked position.

8. The casement window lock of claim 7 wherein said pedestal includes a lip for maintaining at least a portion of said pedestal within said housing when in the biased, extended position.

9. The casement window lock of claim 7 further including a snap-on escutcheon attached to said casing.

10. The casement window lock of claim 1 further including a rotatable position stop for preventing said handle from over-rotating and contacting said casing and ensuring clearance therebetween as said handle is rotated to the unlocked position.

11. A casement window lock, comprising:

a casing having a body including a longitudinal slot in an exterior surface thereof;

a restrictor arm pivotally attached at one end to said casing body, and pivotally attached at the other end to a handle;

an actuator including a fork component for engaging a lock bar, the actuator in slidable communication with said casing body within said longitudinal slot;

said handle in pivotal communication with said actuator at one end of said handle, and in pivotal communication with said restrictor arm at an intermediate point on said handle, said handle movable between locked and unlocked positions, wherein, movement of the handle causes said actuator body to slide within said longitudinal slot in a direction opposite the direction of movement of the handle; and a latch mechanism for releasably retaining said handle in a locked position, said latch mechanism comprising:

a shuttle translatable between a biased latch engaging position and a latch releasing position, the shuttle including a projection integral with or connected to a top surface thereof for engaging an end of said handle when said handle is in a locked position;

a spring normally biasing said shuttle in the latch engaging position; and a latch release depressible in a direction transverse to a longitudinal axis of the casing body, said latch release including an angled face for mating with a correspondingly-angled face of said shuttle, wherein when said latch release is depressed, said angled mating surfaces convert said transverse motion of the latch release into vertical motion of said shuttle to said latch releasing position, thereby compressing said spring and disengaging said shuttle projection from said handle end and allowing said handle to be rotated to an unlocked position.

12. A method of securing a window sash to a casement window frame, said method comprising:

actuating a flush lock for said casement window, wherein said casement window includes an elongated casing having a body defining a longitudinal slot in an exterior surface thereof, and said flush lock includes:

a restrictor arm pivotally attached at one end to said casing body, and pivotally attached at the other end to a handle;

an actuator including a body and a fork component for engaging a lock bar, the actuator body in slidable communication with said casing body within said longitudinal slot;

said handle in pivotal communication with said actuator at one end of said handle, and in pivotal communication with said restrictor arm at an intermediate point on said handle; and a plurality of hinges or pivot points forming an over center linkage to prevent back driving said lock, wherein said over center linkage includes:

a first hinge point rotatably joining said handle to said actuator;

a second hinge point rotatably joining said handle to said restrictor arm;

a third hinge point rotatably joining said restrictor arm to said casing;

said method further comprising:

rotating said handle to an unlocked position, such that said first hinge point is between said second and third hinge points, and said second hinge point is above an action line connecting said first and third hinge points; or rotating said handle to a locked position, such that said second hinge point is between said first and third hinge points, and said second hinge point is below an action line connecting said first and third hinge points; and moving said actuator body within said longitudinal slot in a direction opposite the direction of movement of the handle.

13. The method of claim 12 wherein the flush lock further includes a latch mechanism for releasably retaining said handle in the locked position, said latch mechanism comprising:

a shuttle translatable between a biased latch engaging position and a latch releasing position, the shuttle including a projection integral with or connected to a top surface thereof for engaging an end of said handle when said handle is in the locked position;

a spring normally biasing said shuttle in the latch engaging position; and a latch release depressible in a direction transverse to a longitudinal axis of the casing body, said latch release including an angled face for mating with a correspondingly-angled face of said shuttle, wherein when said latch release is depressed, said angled mating surfaces convert said transverse motion of the latch release into vertical motion of said shuttle to said latch releasing position, thereby compressing said spring and disengaging said shuttle projection from said handle end and allowing said handle to be rotated to the unlocked position, said method further comprising:

engaging said shuttle projection with said end of said handle when said handle is rotated into said locked position to maintain said handle in a flush mounted position within said casing body.

14. The method of claim 13 further comprising:

depressing said latch release in a direction transverse to a longitudinal axis of the casing body to disengage said shuttle projection from said handle end; and rotating said handle to said unlocked position.

15. The method of claim 12 wherein said flush lock further includes a detent formed in an interior surface of said casing body and said actuator includes a detent spring operably coupled to said actuator body, and wherein the method further comprises:

engaging said detent spring with said casing body detent as said handle is rotated to said unlocked position, said detent spring providing tactile and audible indication that said actuator has reached an end of travel.

* * * * *